US008947326B2

(12) United States Patent
Chang et al.

(10) Patent No.: US 8,947,326 B2
(45) Date of Patent: Feb. 3, 2015

(54) PIXEL CIRCUIT, DRIVING METHOD THEREOF AND SELF-EMITTING DISPLAY USING THE SAME

(71) Applicant: Au Optronics Corp., Hsinchu (TW)

(72) Inventors: Hua-Gang Chang, Hsin-Chu (TW); Tsung-Ting Tsai, Hsin-Chu (TW)

(73) Assignee: Au Optronics Corp., Hsin-Chu (TW)

( * ) Notice: Subject to any disclaimer, the term of this patent is extended or adjusted under 35 U.S.C. 154(b) by 249 days.

(21) Appl. No.: 13/678,723

(22) Filed: Nov. 16, 2012

(65) Prior Publication Data

US 2013/0169611 A1 Jul. 4, 2013

(30) Foreign Application Priority Data

Dec. 30, 2011 (TW) ..... 100150022 A

(51) Int. Cl.
*G09G 3/30* (2006.01)
*G09G 3/32* (2006.01)

(52) U.S. Cl.
CPC ..... *G09G 3/3241* (2013.01); *G09G 3/3233* (2013.01); *G09G 2300/0852* (2013.01); *G09G 2300/0861* (2013.01); *G09G 2300/0819* (2013.01)
USPC ..... 345/76; 345/82

(58) Field of Classification Search
CPC ..... G09G 3/30–3/3291
USPC ..... 345/76, 77, 82; 315/169.3
See application file for complete search history.

(56) References Cited

U.S. PATENT DOCUMENTS

| | | | | |
|---|---|---|---|---|
| 8,797,318 | B2 * | 8/2014 | Yoo et al. | 345/419 |
| 8,823,610 | B2 * | 9/2014 | Miyazawa | 345/76 |
| 2003/0112208 | A1 * | 6/2003 | Okabe et al. | 345/82 |
| 2005/0243037 | A1 | 11/2005 | Eom et al. | |
| 2007/0205968 | A1 * | 9/2007 | Chen | 345/76 |
| 2007/0262931 | A1 | 11/2007 | Peng et al. | |
| 2008/0088547 | A1 * | 4/2008 | Chan et al. | 345/76 |
| 2009/0309503 | A1 | 12/2009 | Kim et al. | |
| 2011/0241735 | A1 | 10/2011 | Chou | |
| 2011/0254883 | A1 | 10/2011 | Tsai et al. | |
| 2011/0316892 | A1 | 12/2011 | Sung et al. | |
| 2012/0105421 | A1 | 5/2012 | Tsai et al. | |
| 2012/0127220 | A1 * | 5/2012 | Noguchi | 345/690 |

FOREIGN PATENT DOCUMENTS

| | | | |
|---|---|---|---|
| CN | 1700289 | A | 11/2005 |
| CN | 101609840 | A | 12/2009 |
| CN | 101859539 | | 10/2010 |
| CN | 101859542 | A | 10/2010 |
| CN | 101866619 | A | 10/2010 |

(Continued)

OTHER PUBLICATIONS

China Patent Office, "Office Action", Dec. 2, 2013.

(Continued)

*Primary Examiner* — Chanh Nguyen
*Assistant Examiner* — Roy Rabindranath
(74) *Attorney, Agent, or Firm* — WPAT, PC; Justin King

(57) ABSTRACT

A pixel structure, driving method thereof and self-emitting display using the same is disclosed. The pixel structure includes four transistors and two capacitors to compensate illuminating effect in both of a non-synchronous display mode and a synchronous display mode.

18 Claims, 6 Drawing Sheets

(56) References Cited

FOREIGN PATENT DOCUMENTS

| | | | |
|---|---|---|---|
| CN | 101980330 | A | 2/2011 |
| CN | 102298900 | A | 12/2011 |
| JP | 2003108067 | A | 4/2003 |
| TW | 200802282 | A | 1/2008 |

OTHER PUBLICATIONS

China Patent Office, "Office Action", Jul. 2, 2014.

* cited by examiner

PIXEL CIRCUIT, DRIVING METHOD THEREOF AND SELF-EMITTING DISPLAY USING THE SAME

CROSS-REFERENCE TO RELATED APPLICATIONS

This application is based upon and claims the benefit of priority from the prior Taiwanese Patent Application No. 100150022, filed Dec. 30, 2011, the entire contents of which are incorporated herein by reference.

BACKGROUND

1. Technical Field

The present invention generally relates to display technology fields and, more particularly to a pixel structure for a self-emitting display, a driving method for the pixel structure and a self-emitting display using the pixel structure.

2. Description of the Related Art

Organic Light Emitting Diodes (OLED) can be divided into Passive Matrix OLED (PMOLED) and Active Matrix OLED (AMOLED) according to driving modes thereof. PMOLED does not emit light when no data is written and emits light only when data is written. PMOLED is simple structured, cheaper and easier to design, so at the beginning, PMOLED technology is more popular than AMOLED technology, especially in small and medium size display applications.

A big difference between AMOLED and PMOLED is that each pixel of AMOLED has a storage capacitor to store data, to make the pixel emit light. Since AMOLED apparently consumes less power than PMOLED and the driving method of AMOLED is more suitable for large size and large resolution displays, AMOLED becomes a main direction for future development. FIG. 6 shows one pixel structure of a conventional AMOLED display. Referring to FIG. 6, the pixel structure includes two transistors $T_{R1}$ and $T_{R2}$, a capacitor $C_S$ (2T1C) and a light emitting element $O_1$. The control signal Scan N can conduct the transistor $T_{R1}$ and the potential $V_{data}$ of the display signal can be supplied to the control terminal of the transistor $T_{R2}$ only when data is written. And then, the control signal Scan N is adjusted to cutoff the transistor $T_{R1}$. The charge respectively stored in two terminals of the capacitor $C_S$ is used to control the extent of the conduction of the transistor $T_{R2}$, and so as to control the current flowing through the light emitting element $O_1$.

AMOLED makes progress toward low-power, low-cost, large-size (for example, 40-inch), and full color applications, but also has many design problems. For example, the ununiform of the display panel caused by the variation of material properties and aging materials of the OLED itself or the thin film transistors (TFTs) as a switch or drive components of the OLED is a fairly serious problem. Many compensation circuits have been proposed for compensating the illuminating effect of the display by papers. The proposed compensation circuits are divided into voltage type compensation circuits and current type compensation circuits.

However, with the development of the three-dimensional (3D) display technology, the demand for the stereoscopic display device is increased. A traditional non-synchronous display mode is easy to make mutual interference between the left and right eye pictures, so a synchronous display mode is provided. In the synchronous display mode, the display data are sequentially provided to each pixel structure, and in the end all of the pixel structures are lighting to display the corresponding content.

However, the compensation circuits mentioned above only can be used in non-synchronous display mode but cannot be used in the synchronous display mode. Therefore, how to compensate illuminating effect of the synchronous display panel becomes an issue.

BRIEF SUMMARY

Embodiments of the present invention relate to a pixel structure of a self-emitting display, can be adapted in both of a non-synchronous display mode and a synchronous display mode.

An embodiment of the present invention also relates to a driving method of the pixel structure.

An embodiment of the present invention further relates to a self-emitting display.

A pixel structure of a self-emitting display in accordance with an exemplary embodiment of the present invention is provided. The pixel structure is electrically coupled to a data line, a first power source line, a second power source line, a first control line, a second control line, and a third control line. The pixel structure includes a first transistor, a second transistor, a third transistor, a fourth transistor, a first capacitor, a second capacitor, and a light emitting element. The first transistor includes a first terminal electrically coupled to the data line, a second terminal, and a control terminal electrically coupled to the first control line. The second transistor includes first terminal electrically coupled to the first power source line, a second terminal, and a control terminal electrically coupled to the second control line. The third transistor includes a first terminal electrically coupled to the second terminal of the second transistor, a second terminal, and a control terminal electrically coupled to the second terminal of the first transistor. The fourth transistor includes a first terminal, a second terminal and a control terminal, the first terminal of the fourth transistor being electrically coupled to the second terminal of the third transistor, and the control terminal of the fourth transistor being electrically coupled to the third control line. The first capacitor includes two terminals, wherein a first terminal of those terminals electrically coupled to the second terminal of the first transistor, and a second terminal electrically coupled to the first terminal of the third transistor. The second capacitor includes two terminals, wherein a first terminal of those terminals electrically coupled to the first terminal of the third transistor, a second terminal of those terminals electrically coupled to the first power source line. The light emitting element includes two terminals, one terminal electrically coupled to the second terminal of the fourth transistor and the other terminal electrically coupled to the second power source line.

In an embodiment of the present invention, the first transistor is configured for selectively supplying a display signal supplied by the data line to the first terminal of the first capacitor; and the second transistor is configured for selectively supplying a first power source supplied by the first power source line to the first terminal of the third transistor, the second terminal of the second capacitor, and the second terminal of the first capacitor.

In an embodiment of the present invention, the third transistor is configured for selectively coupling the second terminal of the first capacitor to the first terminal of the fourth transistor; and the fourth transistor is configured for selectively coupling the second terminal of the third transistor to one of the terminals of the light emitting element.

In an embodiment of the present invention, the first transistor, the second transistor, the third transistor, and the fourth transistor are P-type transistors.

In an embodiment of the present invention, the first transistor, the second transistor, the third transistor, and the fourth transistor are N-type transistors.

Another pixel structure of a self-emitting display in accordance with an exemplary embodiment of the present invention is provided. The pixel structure is configured to receive a first power source and a second power source. The pixel structure includes a first transistor, a second transistor, a third transistor, a fourth transistor, a first capacitor, a second capacitor, and a light emitting element. The first transistor includes a first terminal configured for receiving a display signal, a second terminal, and a control terminal configured for receiving a first control signal. The second transistor includes a first terminal configured for receiving the first power source, a second terminal, and a control terminal configured for receiving a second control signal. The third transistor includes a first terminal electrically coupled to the second terminal of the second transistor, a second terminal, and a control terminal electrically coupled to the second terminal of the first transistor. The fourth transistor includes a first terminal electrically coupled to the second terminal of the third transistor, a second terminal, and a control terminal configured for receiving a third control signal. The first capacitor includes a first terminal electrically coupled to the second terminal of the first transistor, and a second terminal electrically coupled to the first terminal of the third transistor. The second capacitor includes a first terminal electrically coupled to the first terminal of the third transistor, and a second terminal configured for receiving the first power source. The light emitting element includes two terminals, one terminal electrically coupled to the second terminal of the fourth transistor and the other terminal configured for receiving the second power source.

In an embodiment of the present invention, the first transistor is configured for selectively supplying the display signal to the first terminal of the first capacitor; the second transistor is configured for selectively supplying the first power source to the first terminal of the third transistor, the second terminal of the second capacitor, and one of the terminals of the first capacitor; the third transistor is configured for selectively coupling the second terminal of the first capacitor to the first terminal of the fourth transistor; and the fourth transistor is configured for selectively coupling the second terminal of the third transistor to one of the terminals of the light emitting element.

A self-emitting display in accordance with an exemplary embodiment of the present invention is provided. A self-emitting display includes a plurality of the pixel structures as claimed in claim 1, a source driver, a scanning driver, and a power supply. The source driver is electrically coupled to the pixel structures and configured for supplying a display signal to the data line. The scanning driver is electrically coupled to the pixel structures and configured for supplying a first control signal to the first control line, a second control signal to the second control line and a third control signal to the third control line. The power supply is electrically coupled to the pixel structures and configured for supplying the first power source to the first power source line and the second power source to the second power source line.

A self-emitting display in accordance with an exemplary embodiment of the present invention is provided. The self-emitting display includes a plurality of the pixel structures, a source driver, a scanning driver, and a power supply. The source drive is electrically coupled to the pixel structures and configured for supplying the display signal to each of the pixel structures. The scanning driver is electrically coupled to the pixel structures and configured for supplying the first control signal, the second control signal and the third control signal to each of the pixel structures. The power supply is electrically coupled to the pixel structures and configured for supplying the first power source and the second power source to each of the pixel structures.

A driving method of the pixel structure is provided. The driving method includes: in a first period, supplying a reference potential to the first control line and setting potentials of the first control line and the second control line to conduct the first transistor and the second transistor; in a second period after the first period, setting potentials of the second control line and the third control line to cutoff the second transistor and conduct the fourth transistor; in a third period after the second period, maintaining the second transistor cutoff and supplying a display signal to the data line, setting the potential of the first control line to make the potential of the control terminal of the third transistor be set according to a data potential of the display signal through the first transistor, and in a fourth period after the third period, setting potentials of the first control line, the second control line and the third control line to cutoff the first transistor and conduct the second and the fourth transistors.

In an embodiment of the present invention, the fourth transistor is conducted in the first, the second, the third and the fourth periods.

In an embodiment of the present invention, the potential of the third control line is set to keep the fourth transistor on the conduction state in the second and fourth periods and on the cutoff state in the first and third periods.

In an embodiment of the present invention, the data potential is supplied to the data line, and the potential of the first control line is set to make the data potential being supplied to the control terminal of the third transistor through the first transistor be a part of the third period.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Reference will now be made to the drawings to describe exemplary embodiments of the present three-dimensional interaction display and operation method thereof, in detail. The following description is given by way of example, and not limitation.

Figure 1:
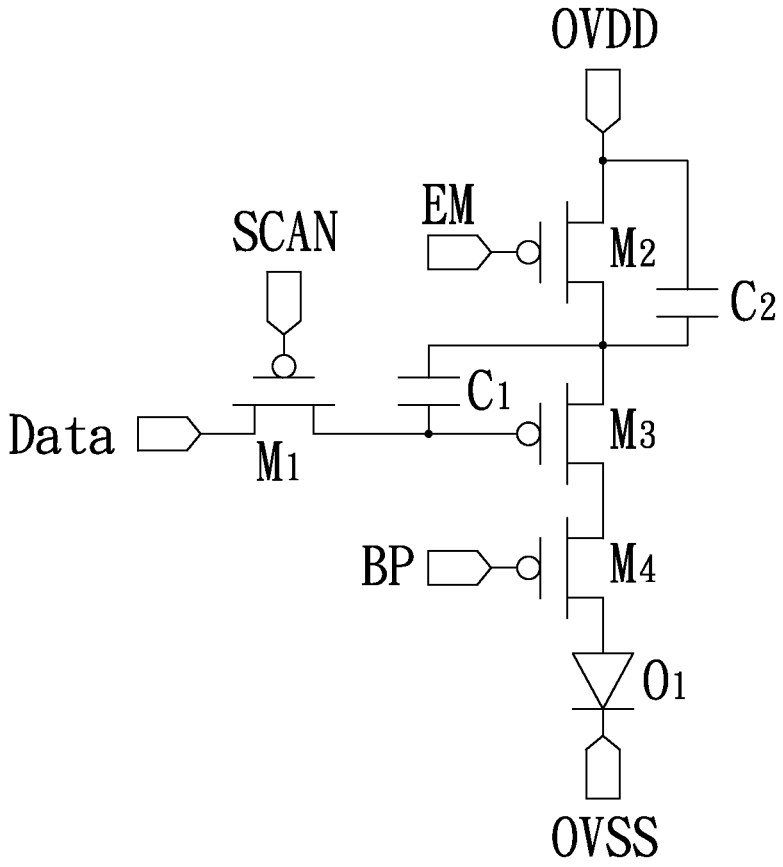
FIG. 1 is a circuit diagram of a pixel structure in accordance with an embodiment of the present invention.

FIG. 1 is a circuit diagram of a pixel structure in accordance with an embodiment of the present invention. Referring to FIG. 1, the pixel structure in the embodiment includes four P-type transistors $M_1$, $M_2$, $M_3$ and $M_4$, two capacitors $C_1$ and $C_2$ and a light emitting element $O_1$. As shown in FIG. 1, one terminal of the P-type transistor $M_1$ is configured for receiving the display signal Data, a control terminal of the P-type transistor $M_1$ is configured for receiving the control signal SCAN, and another terminal of the P-type transistor $M_1$ is electrically coupled to both one terminal of the capacitor $C_1$ and a control terminal of the P-type transistor $M_3$. One terminal of the P-type transistor $M_2$ is electrically coupled to a power source OVDD and one terminal of the capacitor $C_2$. A control terminal of the P-type transistor $M_2$ is configured for receiving the control signal EM. Another terminal of the P-type transistor $M_2$ is respectively electrically coupled to the other terminal of the capacitor $C_1$, the other terminal of the capacitor $C_2$, and one terminal of the P-type transistor $M_3$. Another terminal of the P-type transistor $M_3$ is electrically coupled to one terminal of the P-type transistor $M_4$. Another terminal of the P-type transistor $M_4$ is electrically coupled to one terminal of the light emitting element $O_1$, and a control terminal of the P-type transistor $M_4$ is electrically coupled to the control signal BP. Another terminal of the light emitting element $O_1$ is electrically coupled to the power supply voltage OVSS.

Figure 2:
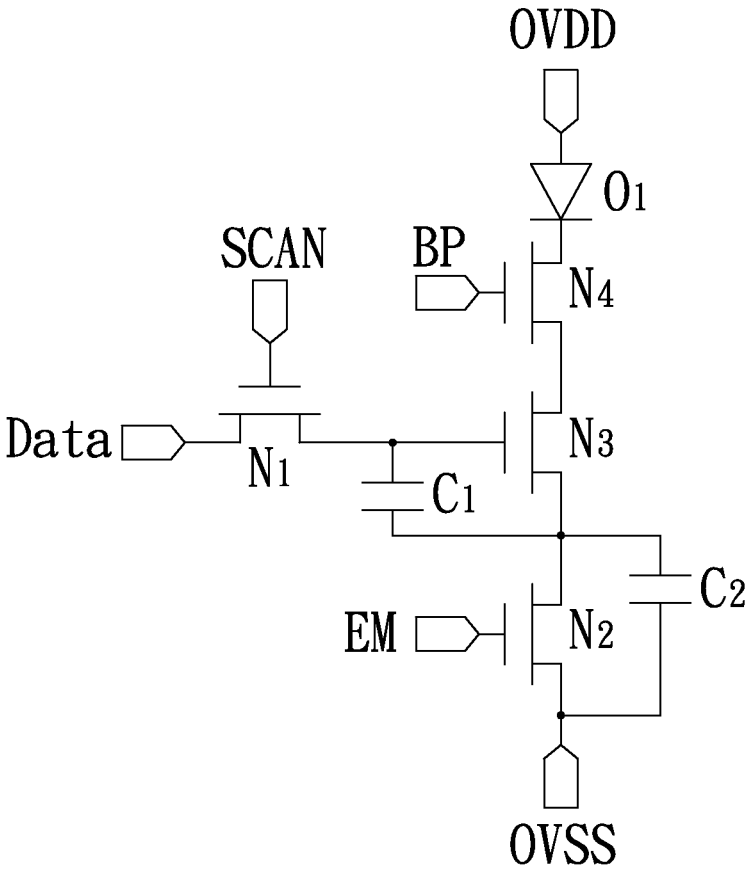
FIG. 2 is a circuit diagram of a pixel structure in accordance with another embodiment of the present invention.

In the exemplary embodiment, all of the transistors are exampled by P-type transistors, in alternative embodiments, all of the transistors can be replaced with N-type transistors. FIG. 2 is a circuit diagram of a pixel structure in accordance with another embodiment of the present invention. Referring to FIG. 2, the pixel structure in another embodiment includes four N-type transistors $N_1$, $N_2$, $N_3$, and $N_4$, two capacitors $C_1$ and $C_2$ and a light emitting element $O_1$.

As shown in FIG. 2, one terminal of the N-type transistor $N_1$ is configured for receiving the display signal Data, a control terminal of the N-type transistor $N_1$ is configured for receiving the control signal SCAN, and another terminal of the N-type transistor $N_1$ is electrically coupled to one terminal of the capacitor $C_1$ and a control terminal of the N-type transistor $N_3$. One terminal of the N-type transistor $N_2$ is electrically coupled to a power source OVSS and one terminal of the capacitor $C_2$. A control terminal of the N-type transistor $N_2$ is configured for receiving the control signal EM. Another terminal of the N-type transistor $N_2$ is respectively electrically coupled to the other terminal of the capacitor $C_1$, the other terminal of the capacitor $C_2$, and the one terminal of the N-type transistor $N_3$. Another terminal of the N-type transistor $N_3$ is electrically coupled to the one terminal of the N-type transistor $N_4$. The another terminal of the N-type transistor $N_4$ is electrically coupled to the one terminal of the light emitting element $O_1$, and the control terminal of the N-type transistor $N_4$ is electrically coupled to a control signal BP. Another terminal of the light emitting element $O_1$ is electrically coupled to a power supply voltage OVDD.

The P-type transistors and N-type transistors mentioned above can be replaced with other types of transistors in accordance with the relevant rules on process, such as field-effect transistors, thin-film transistors, or film field-effect transistors. In addition, the light emitting elements mentioned above can be, but not limited to, light emitting diodes or organic light emitting diodes.

Figure 3:
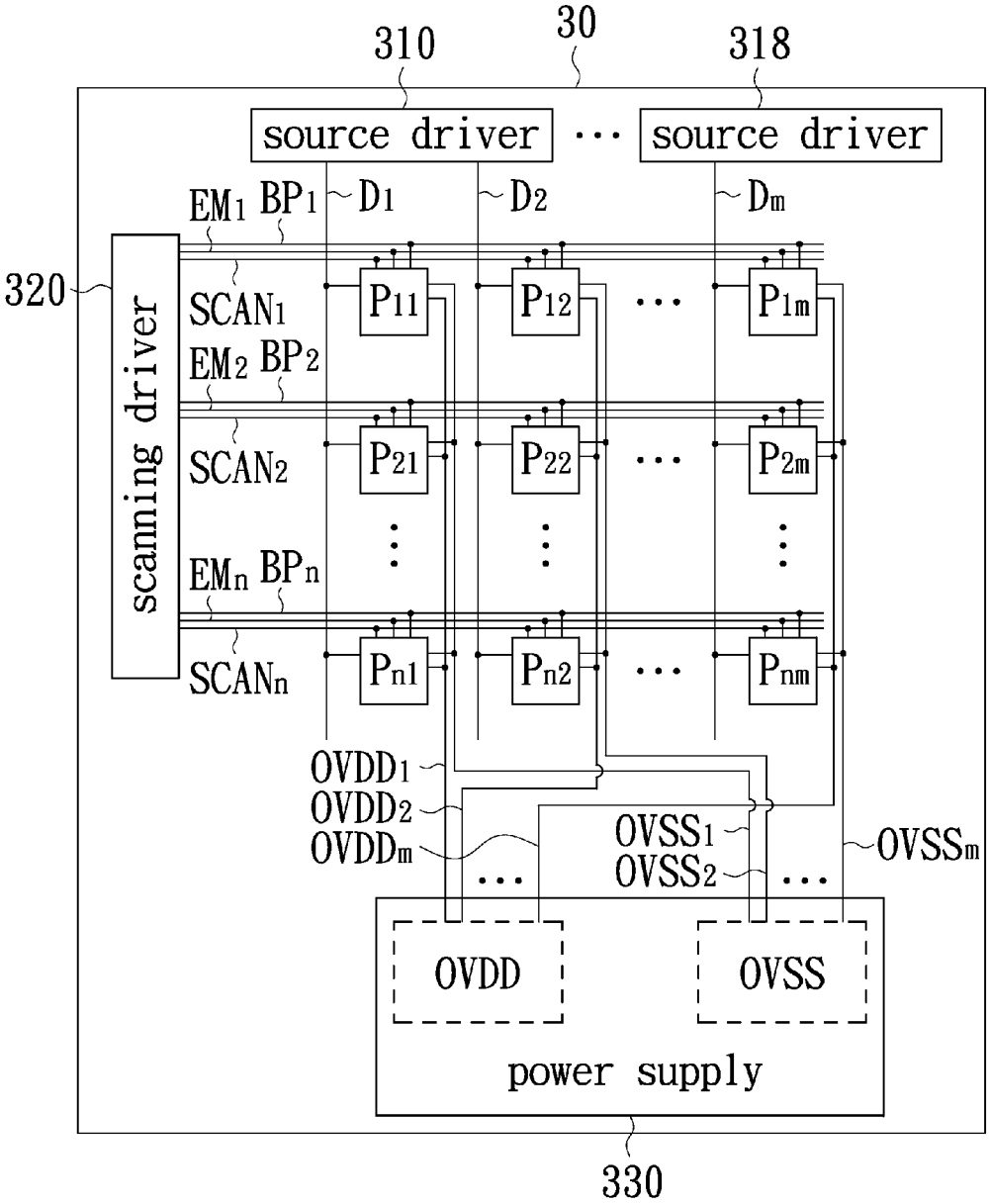
FIG. 3 is a circuit diagram of a self-emitting display in accordance with a embodiment of the present invention.

FIG. 3 is a circuit diagram of a self-emitting display in accordance with an embodiment of the present invention. Referring to FIG. 3, in the embodiment, a self-emitting display 30 includes a plurality of pixel structures ($P_{11}$, $P_{12}$, $P_{1m}$, $P_{21}$, $P_{22}$, $P_{2m}$, $P_{n1}$, $P_{n2}$ . . . $P_{nm}$) a plurality of source drivers 310~318, a scanning driver 320, and a power supply 330. Pnm means the pixel structure is in the n-th row and the m-th column of a matrix of the pixel structures. The numbers of the elements mentioned above is not limited to the numbers shown in the FIG. 3, for example, in alternative embodiments, the plurality of source drivers 310~318 can be replaced by a single source driver 310. The structure of the pixel structures ($P_{11}$, $P_{12}$, $P_{1m}$, $P_{21}$, $P_{22}$, $P_{2m}$, $P_{n1}$, $P_{n2}$ . . . $P_{nm}$) can be same as the pixel structure shown in FIG. 1 or FIG. 2. In the embodiment, the source drivers 310~318 are for generating the display signal Data and respectively supplying the display signal Data to the pixel structures ($P_{11}$, $P_{12}$, $P_{1m}$, $P_{21}$, $P_{22}$, $P_{2m}$, $P_{n1}$, $P_{n2}$, . . . , $P_{nm}$) through data lines ($D_1$, $D_2$, . . . , and $D_m$). The scanning driver 320 is for generating the control signals SCAN, EM, and BP and respectively supplying the control signals SCAN, EM, and BP to the pixel structures ($P_{11}$, $P_{12}$, $P_{1m}$, $P_{21}$, $P_{22}$, $P_{2m}$, $P_{n1}$, $P_{n2}$, . . . , $P_{nm}$) through control lines ($SCAN_1$, $SCAN_2$, . . . , and $SCAN_n$), control lines ($EM_1$, $EM_2$, . . . , and $EM_n$), and control lines ($BP_1$, $BP_2$, . . . , and $BP_n$). More specifically, the control signal SCAN is supplied through the control lines ($SCAN_1$, $SCAN_2$, . . . , and $SCAN_n$), the control signal EM is supplied through the control lines ($EM_1$, $EM_2$, . . . , and $EM_n$), and the control signal BP is supplied through the control lines ($BP_1$, $BP_2$, . . . , and $BP_n$). The power supply 330 supplies the potential generated by power source OVDD to pixel structures ($P_{11}$, $P_{12}$, $P_{1m}$, $P_{21}$, $P_{22}$, $P_{2m}$, $P_{n1}$, $P_{n2}$, . . . , $P_{nm}$) through power source lines ($OVDD_1$, $OVDD_2$, . . . , and $OVDD_m$), and supplies the potential generated by power source OVSS to pixel structures ($P_{11}$, $P_{12}$, $P_{1m}$, $P_{21}$, $P_{22}$, $P_{2m}$, $P_{n1}$, $P_{n2}$, . . . , $P_{nm}$) through power source lines ($OVSS_1$, $OVSS_2$, . . . , and $OVSS_m$). The power source OVDD supplied by the power source lines ($OVDD_1$, $OVDD_2$, . . . , and $OVDD_m$) can be same, and the power source OVSS supplied by the power source lines ($OVSS_1$, $OVSS_2$, . . . , and $OVSS_m$) also can be same.

Referring to FIG. 3 again, each of the pixel structures is electrically coupled to a data line DT, a control line SCANS, a control line EMS, a control line BPS, a power source line OVDDT and a power source line OVSST, wherein $1 \leq S \leq n$ and $1 \leq T \leq m$.

For example, the pixel structure P12 is electrically coupled to the data line $D_2$, the control line $SCAN_1$, $EM_1$ and $BP_1$, and the power source line $OVDD_2$ and $OVSS_2$. To be more specific, if the pixel structure $P_{12}$ is the pixel structure shown in FIG. 1, the one terminal of the P-type transistor M1 is electrically coupled to the data line $D_2$ for receiving the display signal Data. The control terminal of the P-type transistor M1 is electrically coupled to the control line $SCAN_1$ for receiving the control signal SCAN. According to the control signal SCAN, the display signal Data is selectively supplied to the another terminal of the P-type transistor M1 which is electrically coupled to the control terminal of the P-type transistor $M_3$. The one terminal of the P-type transistor M2 is electrically coupled to the power source line $OVDD_2$ to receive the potential of the power source OVDD. The control terminal of the P-type transistor M2 is electrically coupled to the control line $EM_1$ to receive the control signal EM. According to the control signal EM, the potential of the power source OVDD is selectively supplied to the another terminal of the P-type transistor $M_2$ which is electrically coupled to the other terminal of the capacitor $C_1$, the other terminal of the capacitor $C_2$, and the one terminal of the P-type transistor $M_3$. According to the potential supplied to the control terminal of the P-type transistor $M_3$, the one terminal of the capacitor $C_1$ is selectively coupled to the another terminal of the P-type transistor $M_3$ which is electrically coupled to the one terminal of the P-type transistor $M_4$. The control terminal of the P-type transistor $M_4$ is electrically coupled to the control line $BP_1$ to receive the control signal BP. According to the control signal BP, the one terminal of the P-type transistor M4 is selectively coupled to the one terminal of the light emitting element $O_1$.

The pixel structure of the present invention can be used in different display modes according to different needs. Furthermore, no matter in what kind of display mode, the compensation mechanism of the pixel structure is in the same way in the operation, so the pixel structure of the present invention can be adapted in both of a non-synchronous display mode and a synchronous display mode. In synchronous display mode, different lines of pixel structures ($P_{11}$, $P_{12}$, $P_{1m}$, $P_{21}$, $P_{22}$, $P_{2m}$, $P_{n1}$, $P_{n2}$, . . . , $P_{nm}$) is emitting synchronously, and in the non-synchronous display mode the different lines of the pixel structures ($P_{11}$, $P_{12}$, $P_{1m}$, $P_{21}$, $P_{22}$, $P_{2m}$, $P_{n1}$, $P_{n2}$, . . . , $P_{nm}$) is emitting at different time period.

Figure 4:
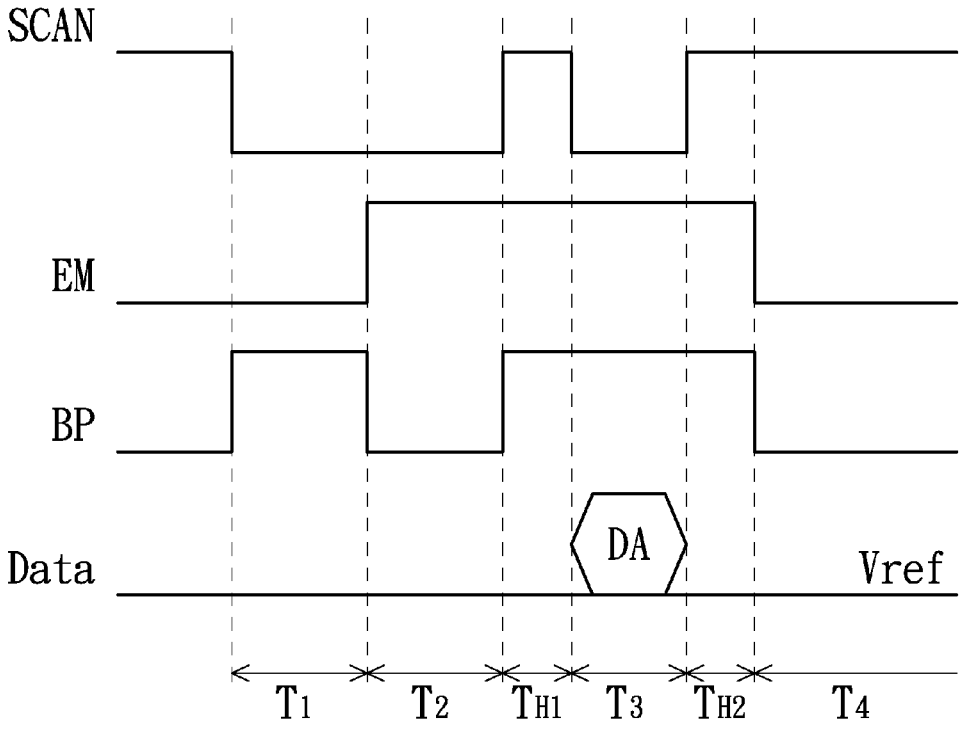
FIG. 4 shows timing diagrams of a driving method of the pixel structure of the present invention in a synchronous display mode.

A driving method for the pixel structures in the embodiment will be described below in detail with reference to FIG. 4. FIG. 4 shows timing diagrams of control signals and a display signal supplied to pixel structures in a synchronous display mode. The driving method can be applied to the pixel structure shown in FIG. 1. Referring to FIGS. 1, 3 and 4, the following will use the pixel structure $P_{11}$ as an example to illustrate the driving method in the present embodiment.

Firstly, in the period $T_1$, the source driver 310 supplies a reference potential $V_{ref}$ to the data line $D_1$ as the potential of the display signal Data. The potential of the signal SCAN supplied by the control line $SCAN_1$ is set to be logical low, the potential of the signal EM supplied by the control line $EM_1$ is set to be logical low, and the potential of the signal BP supplied by the control line $BP_1$ is set to be logical high. Because the potential supplied to the control terminal of the P-type transistor $M_1$ and the control terminal of the P-type transistor $M_2$ is logical low, the P-type transistor $M_1$ and the P-type transistor $M_2$ are conducted. Because the potential supplied to the control terminal of the P-type transistor $M_4$ is logical high, the P-type transistor $M_4$ is cutoff. When the P-type transistor $M_1$ is conducted, i.e. when the potential is $V_{ref}$, the display signal Data is supplied to the control terminal of the P-type transistor $M_3$. In other words, the potential of the control terminal of the P-type transistor $M_3$ is set according to the potential $V_{ref}$. When the P-type transistor $M_2$ is conducted, the potential of the power source OVDD is supplied to the terminal of the P-type transistor $M_2$ which is electrically coupled to the one terminal of the P-type transistor $M_3$. In other words, the potential of the terminal of the P-type transistor $M_2$ which is electrically coupled to the one terminal of the P-type transistor $M_3$ is set according to the potential of the power source OVDD.

Then, in the period $T_2$, the potential of the data line $D_1$ and the control line $SCAN_T$ remain unchanged, the potential of the signal EM supplied by the control line $EM_1$ is set to be logical high, and the potential of the signal BP supplied by the control line $BP_1$ is set to be logical low. In doing so, the P-type transistor $M_2$ is cutoff and the P-type transistor $M_4$ is conducted. The potential of the control terminal of the P-type transistor $M_3$ remains at $V_{ref}$, but the potential of the one terminal of the P-type transistor $M_3$ is gradually changed until the P-type transistor $M_3$ is cutoff. That means, before the P-type transistor $M_3$ is cutoff when the potential thereof is $V_{ref}-V_{th}$, the potential of the control terminal of the P-type transistor $M_3$ changes from the potential of the potential of the power source OVDD to $V_{ref}-V_{th}$, and $V_{th}$ is a threshold value of the P-type transistor $M_3$.

And then, in the period $T_3$, the potential of the control signal EM supplied by the control line $EM_1$ is remained at logical high, and the potential of the of the control signal BP supplied by the control line $BP_1$ is set to be logical high. In this condition, the P-type transistor $M_2$ and the P-type transistor $M_4$ are cutoff.

The driving method is shown in the synchronous display mode, so in the period $T_3$, the pixel structures at different locations need to maintain non luminous (dark) state when the voltage is written in, and the P-type transistor $M_4$ need to maintain cutoff. In addition, in the period $T_3$, each pixel structure need to perform a data charging operation, so for some time in the period $T_3$, the potential of the control signal SCAN will change to logical low. At the same time, a correct display signal DA is supplied to data line $D_1$ (assuming the data potential is $V_{data}$) to make sure the display signal DA can be supplied to the control terminal of the P-type transistor $M_3$. In other words, the potential of the P-type transistor $M_3$ is set according to the display signal DA. Each data line will be electrically coupled to multiple pixel structures, so each data line may need to have different periods to provide display signal to the multiple pixel structures. During the periods of the data line supplying the display signal to a designated pixel structure, the P-type transistor $M_1$ in other pixel structures may need to be cutoff to avoid receiving wrong display signals. These periods are referred to as data holding periods, as $TH_1$ and $TH_2$ shown in FIG. 4.

Along with the display signal DA is supplied to the control terminal of the P-type transistor $M_3$, the potential of the one terminal of the P-type transistor $M_3$ changes to $V_{ref}-V_{th}+dV$, wherein dV is $(V_{data}-V_{ref})*C_1/(C_1+C_2)$, because of the Voltage division of the capacitors $C_1$ and $C_2$.

After all of the display signal being supplied to the corresponding pixel structures, the operation of the pixel structures will leave the period $T_3$ and enter the period $T_4$. The potential of the control signal SCAN supplied by the control line $SCAN_T$ is set to be logical high, the potential of the control signal EM supplied by the control line $EM_1$ is set to be logical low, and the potential of the control signal BP supplied by the control line $BP_1$ is set to be logical low. In doing so, the P-type transistor $M_1$ is cutoff, the P-type transistor $M_2$ and the P-type transistor $M_4$ is conducted, and the light emitting element $O_1$ is turned on.

In the period $T_4$, because the P-type transistor $M_2$ is conducted, the potential of the terminal of the P-type transistor $M_2$ coupled with the P-type transistor $M_3$ will change to the potential supplied by the power source OVDD again. The potential of the control terminal of the P-type transistor $M_3$ will change from the potential Vdata to the potential $V_{data}+OVDD-V_{ref}+V_{th}-dV$.

The brightness of the light emitting element $O_1$ is related to the circulation of current and the circulation of current I of the light emitting element $O_1$ is related to both $V_{GS}$ and $V_{th}$. $V_{GS}$ is the potential difference between the control terminal and the source terminal of the P-type transistor $M_3$, and $V_{th}$ is the threshold value of the P-type transistor $M_3$. The circulation of current I of the light emitting element $O_1$ can be expressed as follows:

$$I=k*(V_{GS}-V_{th})^2$$

$V_{GS}$ can be expressed as $(V_{data}+OVDD-V_{ref}+V_{th}-dV)-(OVDD)$, so the circulation of current I of the light emitting element $O_1$ can also be expressed as:

$$I=k*[(V_{data}+OVDD-V_{ref}+V_{th}-dV)-(OVDD)-V_{th}]^2$$

That is:

$$I=k*[(V_{data}-V_{ref}-dV)]^2$$

Therefore, the light emitting ability of the light emitting element $O_1$ has no relation to characteristic differences between the transistors.

In addition, the driving method of the present invention can also be applied in the non-synchronous display mode. Because non-synchronous display mode does not need to display after all of the pixel structure have been charged, in the periods $T_1$ and $T_3$, the P-type transistor $M_4$ does not need to change to a cutoff of state. In other words, besides in the period $T_1$ and period $T_3$, the P-type transistor $M_4$ is in a conduction state (i.e., the control signal BP maintains logical low), the rest of the operation mode and operating principles are same with the embodiment shown in FIG. 4, here will not repeated.

Figure 5A:
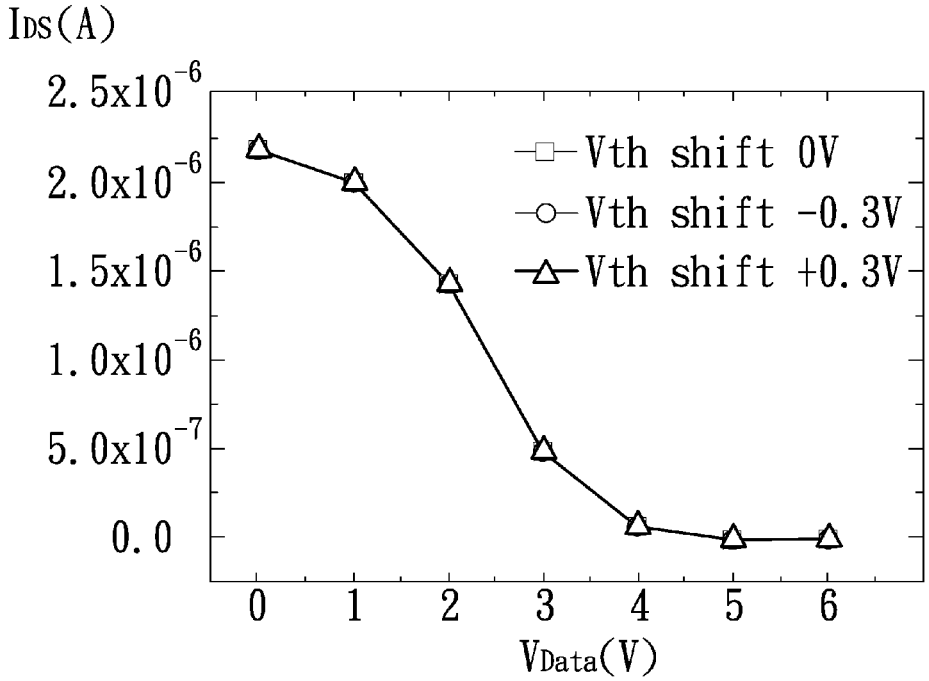
FIG. 5A shows voltage of the display signal dependent current of the light emitting element curve after the driving operation of the pixel structure of the present invention.
Figure 5B:
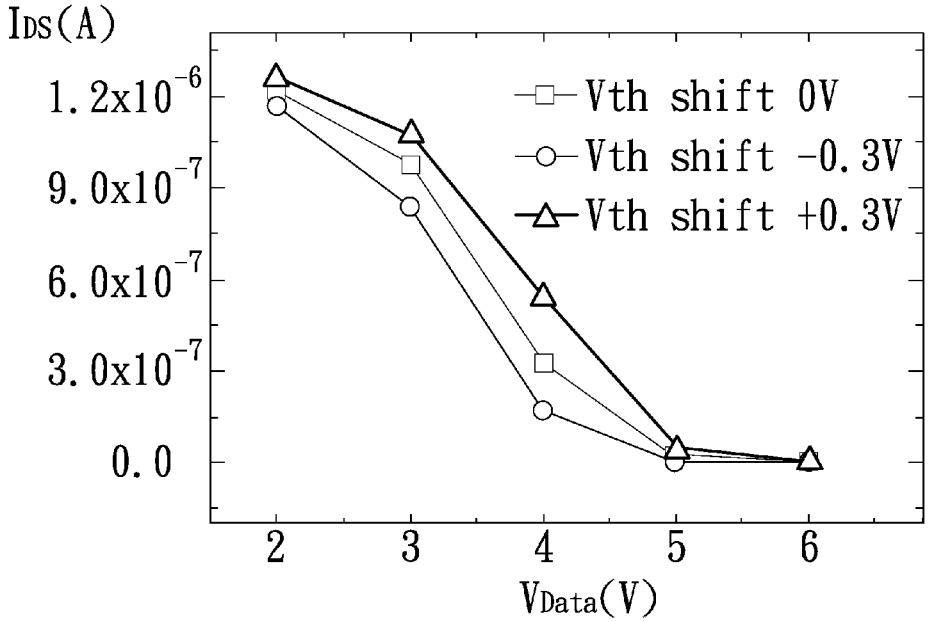
FIG. 5B shows voltage of the display signal dependent current of the light emitting element curve after the driving operation of a 2T1C pixel structure.
Figure 6:
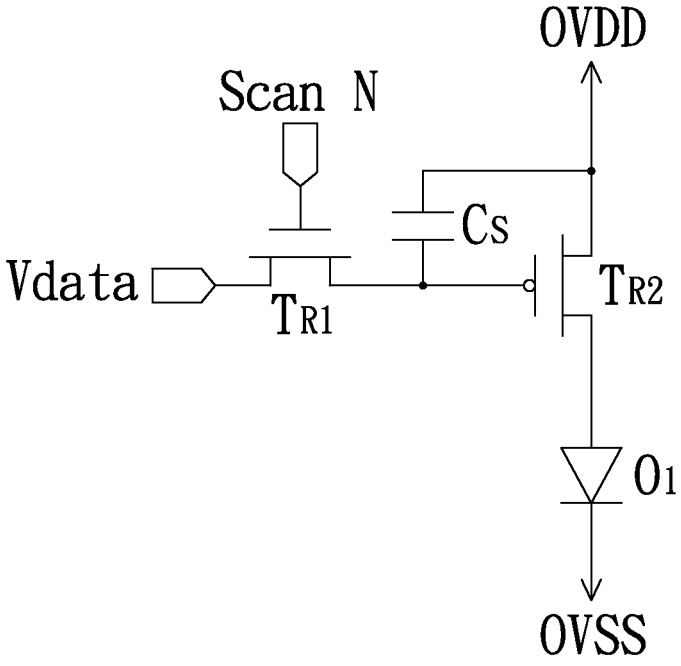
FIG. 6 shows a 2T1C pixel structure of a conventional AMOLED display.

After experiments, the inventors proved the pixel structure and the driving method thereof can well improve the uneven brightness caused by the variation of the threshold of transistor. FIG. 5A shows a voltage of the display signal ($V_{Data}$) dependent current of the light emitting element ($I_{DS}$) curve after the driving operation of the pixel structure of the present invention. FIG. 5B shows a voltage of the display signal ($V_{Data}$) dependent current of the light emitting element ($I_{DS}$) curve after the driving operation of the pixel structure shown in FIG. 6. It can be seen from FIG. 5A, the $V_{Data}$ dependent $I_{DS}$ curves are matched when there has no shift, +0.3V shift, and −0.3V shift of the threshold of transistors. Contrast with FIG. 5B, the degree of improvement is very obvious.

In summary, the embodiments of pixel structure of the present invention can compensate for display brightness in both of the synchronous mode and the non-synchronous display mode, can compensate for uneven brightness caused by the variation of the threshold of transistors, and have a greater scope of application in practical use.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A pixel circuit of a self-emitting display, being electrically coupled to a data line, a first power source line, a second power source line, a first control line, a second control line, and a third control line, the pixel circuit comprising:

a first transistor, comprising a first terminal, a second terminal and a control terminal, the first terminal of the first transistor being electrically coupled to the data line, and the control terminal of the first transistor being electrically coupled to the first control line;

a second transistor, comprising a first terminal, a second terminal and a control terminal, the first terminal of the second transistor being electrically coupled to the first power source line, and the control terminal of the second transistor being electrically coupled to the second control line;

a third transistor, comprising a first terminal, a second terminal and a control terminal, the first terminal of the third transistor being directly and electrically coupled to the second terminal of the second transistor, and the control terminal of the third transistor being directly and electrically coupled to the second terminal of the first transistor;

a fourth transistor, comprising a first terminal, a second terminal and a control terminal, the first terminal of the fourth transistor being directly and electrically coupled to the second terminal of the third transistor, and the control terminal of the fourth transistor being electrically coupled to the third control line;

a first capacitor, comprising a first terminal directly and electrically coupled to the second terminal of the first transistor, a second terminal directly and electrically coupled to the first terminal of the third transistor;

a second capacitor, comprising a first terminal directly and electrically coupled to the first terminal of the third transistor, and a second terminal directly and electrically coupled to the first power source line; and a light emitting element, comprising two terminals, one terminal directly and electrically coupled to the second terminal of the fourth transistor and the other terminal electrically coupled to the second power source line.

2. The pixel circuit as claimed in claim 1, wherein the first transistor is configured for selectively supplying a display signal supplied by the data line to the first terminal of the first capacitor; and the second transistor is configured for selectively supplying a first power source supplied by the first power source line to the first terminal of the third transistor, the second terminal of the second capacitor, and the second terminal of the first capacitor.

3. The pixel circuit as claimed in claim 2, wherein the third transistor is configured for selectively coupling the second terminal of the first capacitor to the first terminal of the fourth transistor; and the fourth transistor is configured for selectively coupling the second terminal of the third transistor to one of the terminals of the light emitting element.

4. The pixel circuit as claimed in claim 1, wherein the third transistor is configured for selectively coupling the second terminal of the first capacitor to the first terminal of the fourth transistor; and the fourth transistor is configured for selectively coupling the second terminal of the third transistor to one of the terminals of the light emitting element.

5. The pixel circuit as claimed in claim 4, wherein the data line is configured to supply a display signal;

the first power source line is configured to supply a first power source;

the second power source line is configured to supply a second power source;

the first control line is configured to supply a first control signal;

the second control line is configured to supply a second control signal; and the third control line is configured to supply a third control signal.

6. The pixel circuit as claimed in claim 1, wherein the data line is configured to supply a display signal;

the first power source line is configured to supply a first power source;

the second power source line is configured to supply a second power source;

the first control line is configured to supply a first control signal;

the second control line is configured to supply a second control signal; and the third control line is configured to supply a third control signal.

7. The pixel circuit as claimed in claim 1, wherein the first transistor, the second transistor, the third transistor, and the fourth transistor are P-type transistors.

8. The pixel circuit as claimed in claim 1, wherein the first transistor, the second transistor, the third transistor, and the fourth transistor are N-type transistors.

9. The pixel circuit as claimed in claim 1, wherein the light emitting element is an organic light emitting diode.

10. A pixel circuit of a self-emitting display, configured to receive a first power source and a second power source, the pixel circuit comprising:

a first transistor, comprising a first terminal configured for receiving a display signal, a second terminal, and a control terminal configured for receiving a first control signal;

a second transistor, comprising a first terminal configured for receiving the first power source, a second terminal, and a control terminal configured for receiving a second control signal;

a third transistor, comprising a first terminal electrically coupled to the second terminal of the second transistor, a second terminal, and a control terminal electrically coupled to the second terminal of the first transistor;

a fourth transistor, comprising a first terminal electrically coupled to the second terminal of the third transistor, a second terminal, and a control terminal configured for receiving a third control signal;

a first capacitor, comprising a first terminal electrically coupled to the second terminal of the first transistor, and a second terminal electrically coupled to the first terminal of the third transistor;

a second capacitor, comprising a first terminal electrically coupled to the first terminal of the third transistor, and a second terminal configured for receiving the first power source; and a light emitting element, comprising two terminals, one terminal electrically coupled to the second terminal of the fourth transistor and the other terminal configured for receiving the second power source;

wherein: the first transistor is configured for selectively supplying the display signal to the first terminal of the first capacitor; and the second transistor is configured for selectively supplying the first power source to the first terminal of the third transistor, the second terminal of the second capacitor, and the second terminal of the first capacitor; and the third transistor is configured for selectively coupling the second terminal of the first capacitor to the first terminal of the fourth transistor; and the fourth transistor is configured for selectively coupling the second terminal of the third transistor to one of the terminals of the light emitting element.

11. The pixel circuit as claimed in claim 10, wherein the third transistor is configured for selectively coupling the second terminal of the first capacitor to the first terminal of the fourth transistor; and the fourth transistor is configured for selectively coupling the second terminal of the third transistor to one of the terminals of the light emitting element.

12. The pixel circuit as claimed in claim 10, wherein the first transistor, the second transistor, the third transistor, and the fourth transistor are P-type transistors.

13. The pixel circuit as claimed in claim 10, wherein the first transistor, the second transistor, the third transistor, and the fourth transistor are N-type transistors.

14. The pixel circuit as claimed in claim 10, wherein the light emitting element is an organic light emitting diode.

15. A driving method applied to a pixel circuit of a self-emitting display, the pixel circuit of the self-emitting display electrically coupled to a data line, a first power source line, a second power source line, a first control line, a second control line, and a third control line, the pixel circuit of the self-emitting display including a first transistor, a second transistor, a third transistor, a fourth transistor, a first capacitor, a second capacitor and a light emitting diode, a first terminal of the first transistor electrically coupled to the data line, and a control terminal of the first transistor electrically coupled to the first control line, a first terminal of the second transistor electrically coupled to the first power source line, and a control terminal of the second transistor electrically coupled to the second control line, a first terminal of the third transistor electrically coupled to the second terminal of the second transistor, and a control terminal of the third transistor electrically coupled to the second terminal of the first transistor, a first terminal of the fourth transistor electrically coupled to the second terminal of the third transistor, and a control terminal of the fourth transistor electrically coupled to the third control line, a first terminal of the first capacitor electrically coupled to the second terminal of the first transistor, a second terminal of the first capacitor electrically coupled to the first terminal of the third transistor, a first terminal of the second capacitor electrically coupled to the first terminal of the third transistor, and a second terminal of the second capacitor electrically coupled to the first power source line, one terminal of the light emitting element electrically coupled to the second terminal of the fourth transistor and the other terminal of the light emitting element electrically coupled to the second power source line, the driving method comprising:

in a first period, supplying a reference potential to the first control line and setting potentials of the first control line and the second control line to conduct the first transistor and the second transistor, respectively;

in a second period after the first period, setting potentials of the second control line and the third control line to cutoff the second transistor and conduct the fourth transistor, respectively;

in a third period after the second period, maintaining the second transistor cutoff and supplying a display signal to the data line, setting the potential of the first control line to make the potential of the control terminal of the third transistor be set according to a data potential of the display signal through the first transistor, and in a fourth period after the third period, setting potentials of the first control line, the second control line and the third control line to cutoff the first transistor and conduct the second and the fourth transistors, respectively.

16. The driving method as claimed in claim 15, wherein the fourth transistor is conducted in the first, the second, the third and the fourth periods.

17. The driving method as claimed in claim 15, wherein the potential of the third control line is set to keep the fourth transistor on the conduction state in the second and fourth periods and on the cutoff state in the first and third periods.

18. The driving method as claimed in claim 15, wherein the data potential is supplied to the data line, and the potential of the first control line is set to make the data potential being supplied to the control terminal of the third transistor through the first transistor be a part of the third period.

* * * * *